US006499202B1

(12) United States Patent
Milanese et al.

(10) Patent No.: US 6,499,202 B1
(45) Date of Patent: Dec. 31, 2002

(54) QUICK-STRIP STRETCHER FOR TUBULAR FABRIC

(75) Inventors: Renzo Milanese, Marano Ticino; Giancarlo Ferraro, Somma Lombardo, both of (IT)

(73) Assignee: FERRARO S.p.A., Lonate Pozzolo (IT)

( * ) Notice: Subject to any disclaimer, the term of this patent is extended or adjusted under 35 U.S.C. 154(b) by 0 days.

(21) Appl. No.: 09/830,661

(22) PCT Filed: Oct. 28, 1999

(86) PCT No.: PCT/IT99/00345

§ 371 (c)(1),
(2), (4) Date: Apr. 26, 2001

(87) PCT Pub. No.: WO00/26460

PCT Pub. Date: May 11, 2000

(30) Foreign Application Priority Data

Nov. 4, 1998 (IT) ..... MI98A2372

(51) Int. Cl.[7] ..... D06C 5/00
(52) U.S. Cl. ..... 26/80; 26/83
(58) Field of Search ..... 26/80, 82, 83, 26/84, 85, 87, 97, 98

(56) References Cited

U.S. PATENT DOCUMENTS

| | | | | | |
|---|---|---|---|---|---|
| 2,623,263 | A | * | 12/1952 | Dungler | 26/84 |
| 2,623,264 | A | * | 12/1952 | Dungler | 26/80 |
| 3,078,541 | A | * | 2/1963 | Beard | 26/84 |
| 4,473,929 | A | * | 10/1984 | Green | 26/80 |
| 4,947,529 | A | * | 8/1990 | Werner et al. | 26/83 |
| 5,594,978 | A | * | 1/1997 | Ferrero | 26/83 |
| 5,701,641 | A | * | 12/1997 | Catallo | 26/84 |
| 5,867,879 | A | * | 2/1999 | Ferraro et al. | 26/84 |
| 5,884,376 | A | * | 3/1999 | Bertoldo | 26/83 |

FOREIGN PATENT DOCUMENTS

| | | | |
|---|---|---|---|
| EP | 267880 | * | 5/1988 |
| WO | WO9615303 | * | 5/1996 |

* cited by examiner

*Primary Examiner*—Amy B. Vanatta
(74) *Attorney, Agent, or Firm*—Dann, Dorfman, Herrell and Skillman; Henry H. Skillman; Biebel & French

(57) ABSTRACT

A stretcher comprising: two stretcher arms (1), the stretcher arms being provided with idle shaped rings (5), driving wheels (2*a*, 2*b*), and two pairs of inclined wheels (4, 4') in correspondence with the shaped rings (5), in which the inclined wheels (4, 4') are respectively mounted on two plates (12, 13) that are adjacent to the arms (1) and detachably interconnected to each other with the possibility of disengaging the arms (1) from the plates (12, 13).

6 Claims, 2 Drawing Sheets

QUICK-STRIP STRETCHER FOR TUBULAR FABRIC

The object of the present invention is a stretcher for tubular knitwear fabric, especially for application to calenders or other machines for the treatment of tubular fabric.

It is known that stretchers are used during the finishing step of tubular knitwear articles for stretching and spreading the tubular article in order to ease the finishing operations. This operation causes impurities to be deposited onto the plates and onto the members the stretcher is comprised of.

The purpose of the present invention is to obviate this draw-back by adapting the stretcher such that it can be dismounted, thereby providing the benefit of possibly providing in a simple fast way for the maintenance and clean-up of the whole stretcher.

The features, advantages and the solution of the technical problem at the basis of the invention will be evident from the following detailed description of a preferred, non exclusive embodiment of the subject stretcher which is illustrated in a merely illustrative, non limiting way in the accompanying figures, in which.

Figure 1:
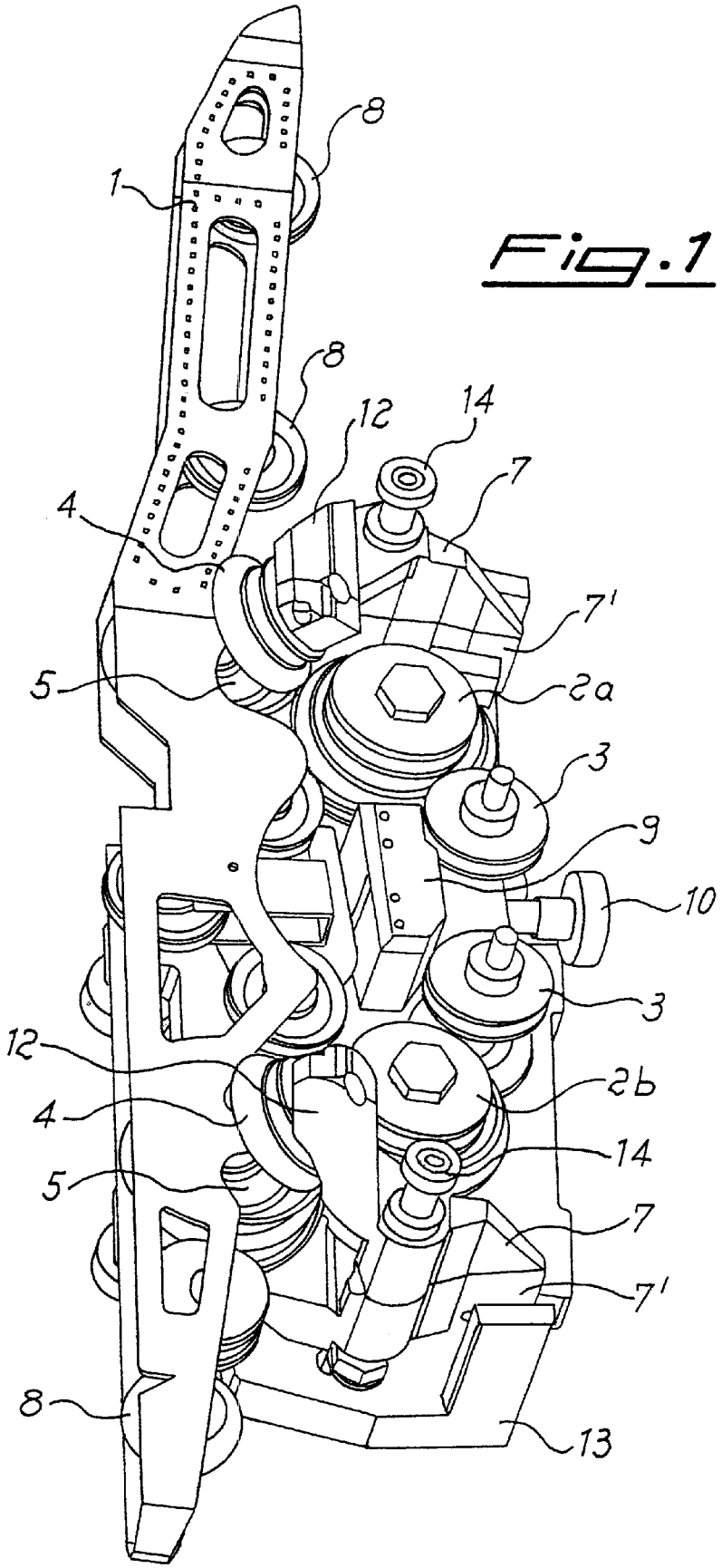
FIG. 1 shows a partial perspective view of the stretcher.

The stretcher comprises: two stretcher arms 1, only the right-side stretcher being represented in FIG. 1; the upper driving wheels 2*a* and the lower driving wheels 2*b* that are interconnected by means of an elastic belt that is not shown on the figure; idle pulleys 3; and the inclined wheels 4.

As can be seen from FIG. 1, the stretcher arm 1 carries the rings 5 which are provided with outlines 6. These rings are arranged in front of the bulging portion the driving wheels 2*a* and 2*b* are provided with. These have in turn supports 7 that support the wheels 4 with inclined axis. The wheels 4 with their peripheral parts are spaced apart from the circumferential outlines 6 of rings 5, this being due to the magnetic attraction force that acts onto the arms, as will be explained hereinafter.

The transportation of the tubular fabric is carried out by means belts that are not reproduced in the figure, said belts being wound around a set of pulleys 8 that are idly supported on the arms 1, along the contour of the driving wheels 2*a* and 2*b* and of the rings 5.

Both of the inclined wheels 4 are driven as they are connected to each other by means of an elastic belt (not shown in the figure) that is wound around the driving wheels 2*a* and 2*b* and the idle pulleys 3. Similarly, the inclined wheels 4', shown in FIG. 2 as coupled to wheels 4, are driven because they are connected by means of belts to the same driving wheels 2*a* and 2*b*.

Wheels 4 and 4' are kept spaced apart from the rings 5 by means of magnets 9 that attract the arms outwards together with the rings 5, that in turn are attracted against the driving wheels 2*a* and 2*b*.

Moreover there is to be noted that the attraction force of magnets 9 is adjustable, so that the gap between the rings 5 and the inclined wheels 4 and 4' is assured. The adjustment is obtained by means of a mechanism that causes the magnets 9 to move towards to or away from the arms 1, respectively. In fact the magnets 9 are connected to the mechanism, which is provided with an adjustment hand grip 10, said hand grip being suited to cause the magnets 9 to move towards to or away from the supports 11 that are fixedly connected to the bars 1.

According to the novel feature of the present invention, the two pairs of inclined wheels 4, 4' are respectively mounted on the supports 7, 7' that are integral with the plates 12 and 13, said plates being detachably connected to each other, with the possibility of disengaging the arms 1 from the plates 12 and 13. In particular, two studs 14 detachably connect the plates 12, 13 and are respectively mounted on supports 7, 7'.

The inclined wheels 4 are supported by the upper support 7, whilst the inclined wheels 4' are supported by the lower support 7'.

Figure 2:
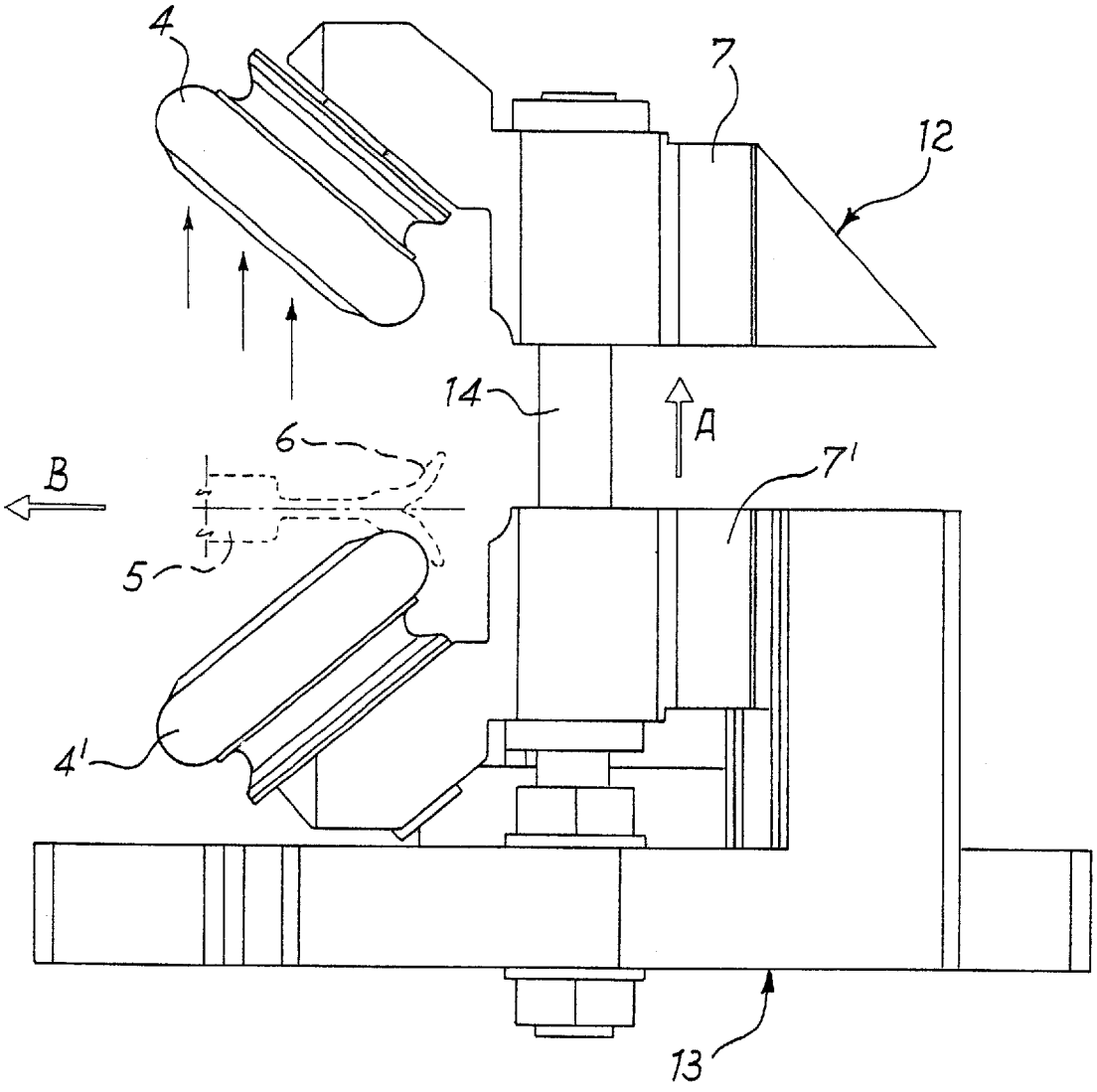
FIG. 2 shows a partial view of the stretcher in the dismounting step.

The operation is as follows:

the magnets 9 are moved away from the arms 1, so that the latter together with the rings 5 are kept in the right position because the inclined wheels 4, 4' press against the bulging portions of the rings 5. Thereafter the supports 7 are slipped off the studs 14 according to arrow A and the arms together with the rings are removed according to arrow B, as shown in FIG. 2. Thus maintenance and clean-up from the impurities that deposit during operation onto all the parts of the group, that is onto the plates 12 and 13 and onto the arms 1, will be convenient and fast.

Modifications of a practical applicative nature will possibly be made in the construction details of the embodiment that will remain within the range of the invention, as claimed hereinbelow.

What is claimed is:

1. A stretcher comprising: two stretcher arms (1), said stretcher arms being provided with idle shaped rings (5), driving wheels (2*a*, 2*b*), and two pairs of inclined wheels (4, 4') in correspondence with said shaped rings (5), characterised in that said inclined wheels (4, 4') are respectively mounted on two plates (12, 13) that are adjacent to said arms (1) and detachably interconnected to each other with the possibility of disengaging said arms (1) from the plates (12, 13).

2. A stretcher as claimed in claim 1, characterised in that it comprises at least two studs (14) detachably connecting the plates (12, 13).

3. A stretcher as claimed in claim 2, characterised in that said studs (14) are each mounted onto two pairs of supports (7, 7') that are respectively part of the plates (12, 13), said supports (7, 7') supporting the inclined wheels (4, 4'), respectively.

4. A stretcher as claimed in claim 1, characterized in that magnets (9), depending on their position, are suited to attract the arms (1) outwards with the rings (5) removed from the inclined wheels (4, 4'), or not to attract said arms (1), thereby allowing said arms (1) to be freely disengaged from said plates (12, 13).

5. A stretcher as claimed in claim 2, characterized in that magnets (9), depending on their position, are suited to attract the arms (1) outwards with the rings (5) removed from the inclined wheels (4, 4'), or not to attract said arms (1), thereby allowing said arms (1) to be freely disengaged from said plates (12, 13).

6. A stretcher as claimed in claim 3, characterized in that magnets (9), depending on their position, are suited to attract the arms (1) outwards with the rings (5) removed from the inclined wheels (4, 4'), or not to attract said arms (1), thereby allowing said arms (1) to be freely disengaged from said plates (12, 13).

* * * * *